US011807430B2

(12) United States Patent
Polloni et al.

(10) Patent No.: US 11,807,430 B2
(45) Date of Patent: Nov. 7, 2023

(54) PACKAGE WITH SLIDING OPENING FOR CONSUMER GOODS

(71) Applicant: G.D SOCIETA' PER AZIONI, Bologna (IT)

(72) Inventors: Roberto Polloni, Bologna (IT); Luca Paradiso, Bologna (IT); Lorena D'Alfonso, Bologna (IT); Giuliano Gamberini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 17/771,361

(22) PCT Filed: Oct. 23, 2020

(86) PCT No.: PCT/IB2020/059982
§ 371 (c)(1),
(2) Date: Apr. 22, 2022

(87) PCT Pub. No.: WO2021/079335
PCT Pub. Date: Apr. 29, 2021

(65) Prior Publication Data

US 2022/0363431 A1 Nov. 17, 2022

(30) Foreign Application Priority Data

Oct. 24, 2019 (IT) ..... 102019000019748

(51) Int. Cl.
*B65D 5/38* (2006.01)
*B65D 1/36* (2006.01)
(Continued)

(52) U.S. Cl.
CPC ..... *B65D 5/38* (2013.01); *B65D 1/36* (2013.01); *B65D 5/4233* (2013.01);
(Continued)

(58) Field of Classification Search
CPC ... B65D 1/36; B65D 5/38; B65D 5/42; B65D 5/4233; B65D 50/04; B65D 51/20;
(Continued)

(56) References Cited

U.S. PATENT DOCUMENTS 3,049,224 A * 8/1962 Fredette ..... B65D 51/20 229/125.05
5,269,404 A * 12/1993 Wischusen, III ..... B65D 5/38 229/123.1

(Continued)

FOREIGN PATENT DOCUMENTS

DE 102007030267 A1 1/2009
EP 2423128 A1 2/2012

(Continued)

OTHER PUBLICATIONS

International Search Report and Written Opinion for Corresponding International Application No. PCT/IB2020/059982 dated Feb. 26, 2021.

*Primary Examiner* — Bryon P Gehman
(74) *Attorney, Agent, or Firm* — MARSHALL, GERSTEIN & BORUN LLP

(57) ABSTRACT

A package with a sliding opening for consumer goods can include a group of consumer goods; a container that is tub-shaped, which contains the group of consumer goods and comprises an extraction opening for the extraction of consumer goods; a closing label, which is fixed in a repositionable manner to the first container to open and close the extraction opening; a covering of the first container, which is made starting from a blank of wrapping material; a casing made starting from a blank of wrapping material. The casing is arranged externally to the covering and is slidingly coupled to the covering to be movable between a closing position, in which access to the group of consumer goods is
(Continued)

not allowed, and an opening position, in which access to the group of consumer goods is allowed.

17 Claims, 9 Drawing Sheets

(51) Int. Cl.
*B65D 5/42* (2006.01)
*B65D 85/10* (2006.01)
*B65D 85/60* (2006.01)

(52) U.S. Cl.
CPC ..... *B65D 85/1036* (2013.01); *B65D 85/60* (2013.01); *B65D 2209/00* (2013.01)

(58) Field of Classification Search
CPC .... B65D 85/10; B65D 85/1036; B65D 85/60; B65D 2209/00
USPC ..... 220/345.1; 229/125.125
See application file for complete search history.

(56) References Cited

U.S. PATENT DOCUMENTS

| | | | | |
|---|---|---|---|---|
| 8,627,951 | B2 | 1/2014 | Buse et al. | |
| 2019/0276203 | A1* | 9/2019 | French | B65D 1/36 |

FOREIGN PATENT DOCUMENTS

| | | | | |
|---|---|---|---|---|
| JP | 10175666 | A | * | 6/1998 |
| WO | WO-2019/064029 | A1 | | 4/2019 |

* cited by examiner

PACKAGE WITH SLIDING OPENING FOR CONSUMER GOODS

CROSS-REFERENCE TO RELATED APPLICATIONS

This Patent Application is a U.S. national phase of International Patent Application No. PCT/IB2020/059982 filed Oct. 23, 2020, which claims the benefit of priority from Italian patent application no. 102019000019748 filed on Oct. 24, 2019, the respective disclosures of which are each incorporated herein by reference in their entireties.

TECHNICAL FIELD

The present invention relates to a package with sliding opening for consumer goods.

In particular, the present invention is applicable to the confectionery field and in the tobacco industry. The package, in fact, can contain confectionery products, such as sweets, chocolates, sugared almonds or smoking articles such as snus, cartridges for electronic cigarettes or cigarettes. In particular, the present invention is advantageously applied to consumer goods which must preserve their characteristics over time, such as aroma or degree of moisture.

BACKGROUND ART

It is known that confectionery and tobacco industry (in particular containing tobacco) consumer goods must be properly stored in order to preserve the moisture/aroma of the products. With reference to the tobacco industry, this problem is particularly emphasized in some products, such as snus or certain cartridges for electronic cigarettes, in which the tobacco, in order to ensure optimal flavour during use must preserve a high degree of moisture. For this purpose, it is known to store said consumer goods inside boxes made of plastic that are able to preserve the moisture of the product.

The patent application DE102007030267A1 describes a rigid package of cigarettes with a hinged lid which houses a sealed inner wrap provided with a removal opening coupled to a closing flap that can be reused several times.

The patent application EP2423128A1 describes a tobacco package comprising a pocket designed to receive loose tobacco and a closing structure which is movable relative to the pocket from a closing position, in which the closing structure closes an access opening of the pocket, to an opening position in which the access opening of the pocket is accessible.

The patent application WO2019064029A1 describes a package of a sliding type comprising a sleeve which has a closed end and an open end and a container which is insertable and removable from the sleeve through the open end of the sleeve.

DISCLOSURE OF INVENTION

However, in order to reduce the use of plastic for environmental reasons, the object of the present invention is to propose a package which ensures the preservation of the characteristics of the consumer goods in the face of a reduction in the quantity of plastic used in making the package.

The aforesaid object has been achieved by means of a package with a sliding opening for consumer goods according to claim 1.

BRIEF DESCRIPTION OF THE DRAWINGS

The present invention will now be described with reference to the attached drawings, which illustrate some non-limiting examples of embodiment thereof, wherein.

BEST MODE FOR CARRYING OUT THE INVENTION

Figure 1:
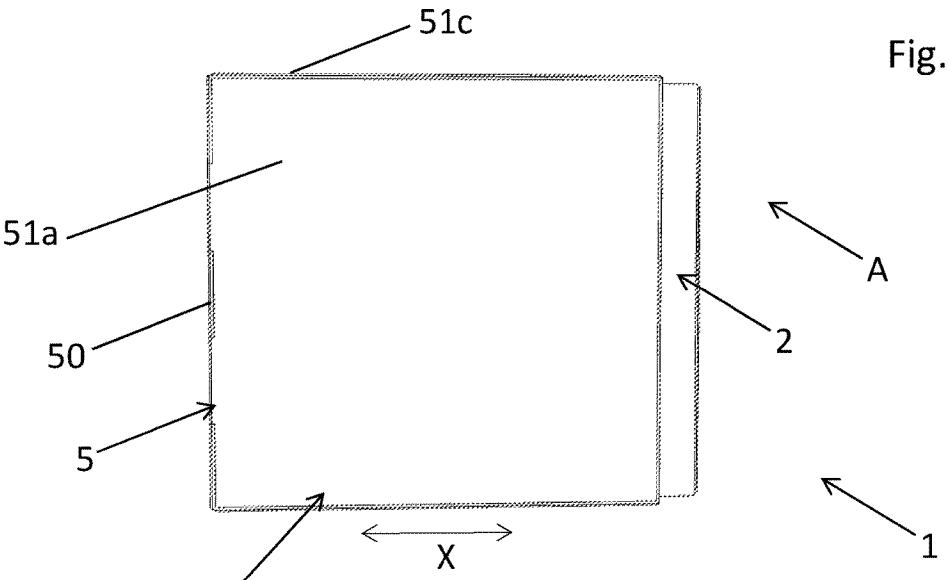
FIG. 1 is a top view of a first embodiment of the package object of the present invention, which package is in the closing position.

With reference to the attached figures, the numerical reference 1 generally denotes a package with a sliding opening for consumer goods object of the present invention.

Said package 1 contains a group of consumer goods (not illustrated) which can be consumer goods arranged neatly within the package 1 or can be loose consumer goods.

The term "loose consumer goods" refers to consumer goods from various merchandise sectors such as confectionery consumer goods, such as sweets, sugared almonds or chocolates or consumer goods from the tobacco industry. The term consumer goods of the tobacco industry refers to products such as cigarettes, cigars, snus, cartridges for electronic cigarettes.

In particular, the package object of the present invention finds advantageous application with consumer goods which must preserve their characteristics (humidity/aroma) over time; for example, the package is particularly advantageous for consumer goods of the tobacco industry that must preserve a high humidity degree of tobacco over time (e.g. snus).

With reference to the attached figures, the package 1 comprises: a group of consumer goods; a first container 2 that is tub-shaped, which contains the group of consumer goods, and comprises an extraction opening 20 for the extraction of consumer goods from the first container 2; a first closing label which is fixed in a repositionable manner to the first container 2 to open and close the extraction opening 20 and to allow or prevent access to the group of consumer goods through the extraction opening 20; a covering 4 of the first container 2 which is made starting from a blank of wrapping material; a casing 5 made starting from a blank of wrapping material, which casing 5 is arranged externally to the covering 4 and is slidingly coupled to the covering 4 so that the casing 5 and the covering 4 are mutually movable along a sliding direction X between a closing position A, in which access to the group of consumer goods contained in the first container 2 is not allowed, and an opening position B, in which access to the group of consumer goods contained in the first container 2 is allowed.

The first container 2 and the closing label 3 are mutually arranged and shaped so as to form, when the package 1 is in the closing position A, a sealed package 1 capable of preserving the characteristics of the consumer goods contained in the first container 2. The term "sealed package" refers to a package capable of preserving the characteristics, such as aroma and moisture, of the consumer goods contained therein; in other words, this signifies a package capable of maintaining the characteristics of consumer goods unchanged (or in any case above a threshold value) over time.

Advantageously, the package 1 object of the present invention allows to preserve the characteristics (for example, the degree of humidity) of the consumer goods it contains and at the same time reduces the consumption of plastic to a minimum in producing the package 1: the covering 4 and the casing 5 are made of wrapping materials and only the first container 2 could possibly be made of a plastic material.

In particular, the blanks of wrapping materials from which the covering 4 and the casing 5 are made are paper or cardboard blanks.

With reference to FIGS. 1-9, a first embodiment of the package 1 object of the present invention is described in the following.

The package 1 has a substantially square shape 1 in plan view when it is in the closing position A (FIG. 1). It is understood that it could also have a rectangular shape.

The casing 5 is cup-shaped and comprises a bottom wall 50 and a sleeve portion 51 which extends from the bottom wall 50. The bottom wall 50 has a rectangular shape and the sleeve portion 51 comprises four walls two-by-two opposite and parallel to one another. In particular, the sleeve portion 51 comprises an upper wall 51*a*, a lower wall 51*b* and two lateral sides 51*c*. According to an alternative embodiment not illustrated, the casing 5 may not provide the bottom wall; in this case, the casing 5 would be sleeve-shaped.

Figure 2:
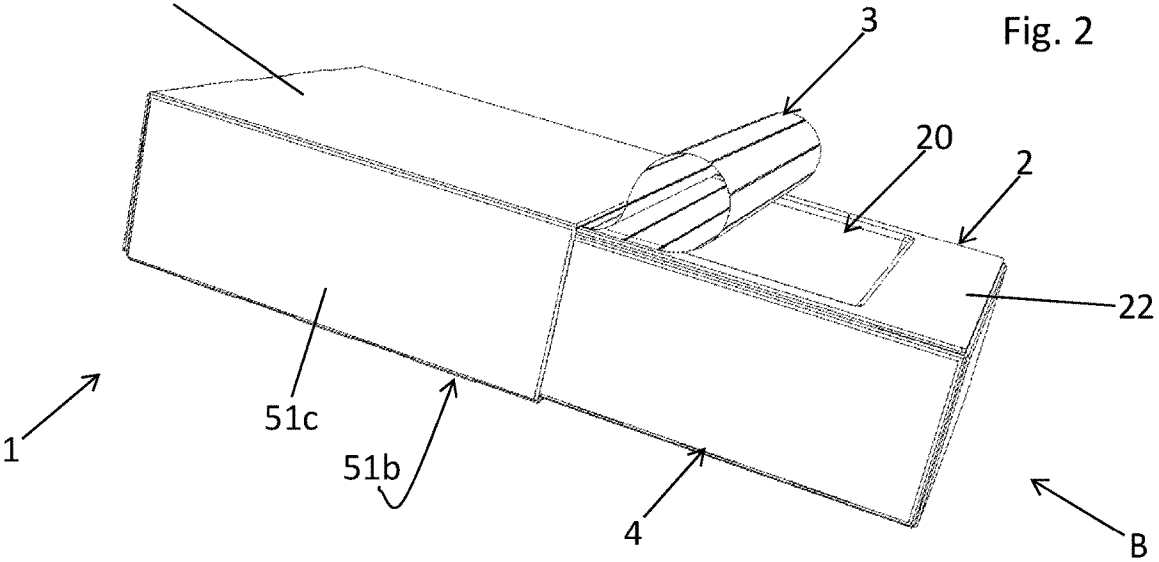
FIG. 2 is a perspective view of the package of FIG. 1, which package is in the opening position.
Figure 3:
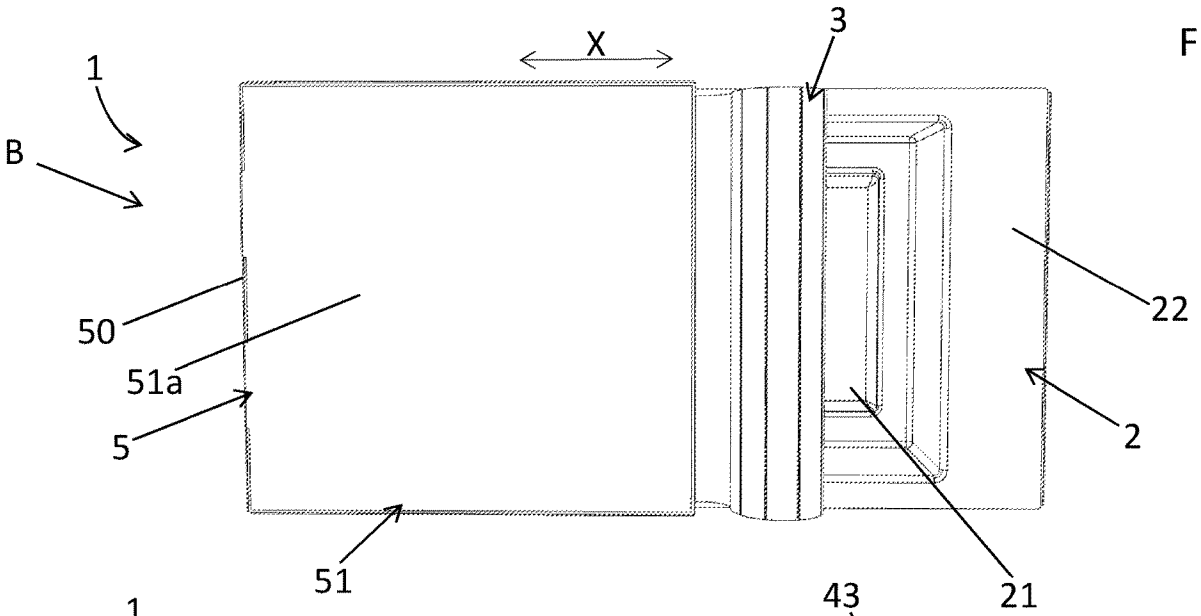
FIGS. 3 and 4 are views, from above and from below, respectively, of the package of FIG. 2.
Figure 4:
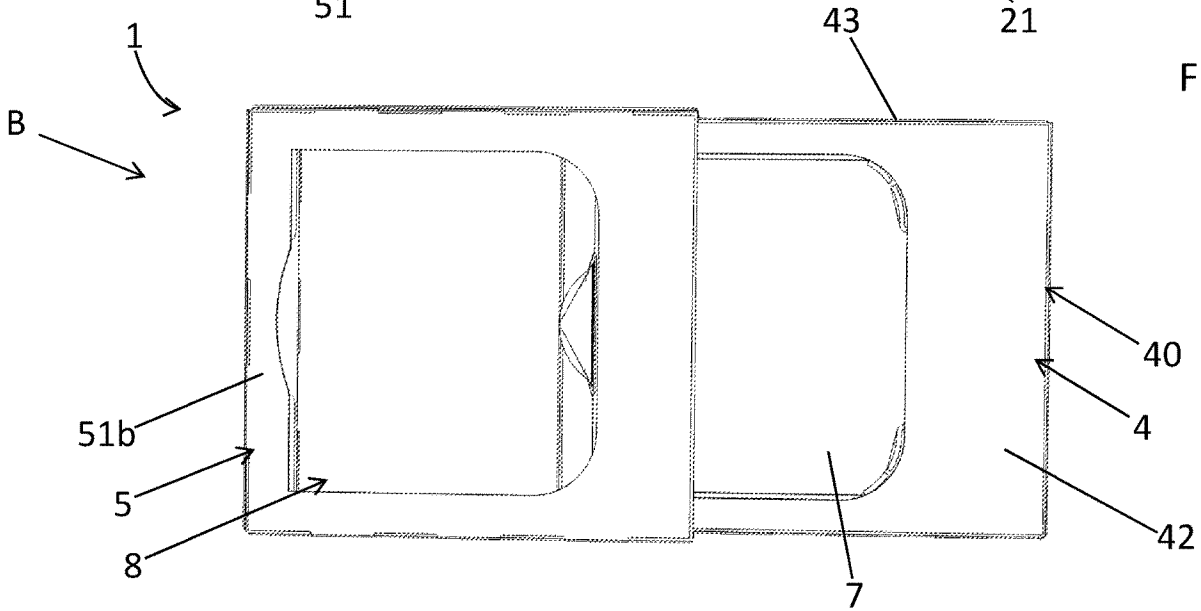

With particular reference to FIGS. 2 and 3, the covering 4 comprises an annular wall 40 which engages in the inner surface of the casing 5 to slide with respect to the casing 5 between the closing position A and the opening position B.

The annular wall 40 comprises an upper surface 41 which extends parallel to the sliding direction X. Furthermore, the annular wall 40 comprises a lower surface 44 that is opposite and parallel to the upper surface 41 and four lateral surfaces 43 that are two-by-two opposite and parallel to one another and which are orthogonal to the upper surface 41 and to the lower surface 44.

When the covering 4 and the casing 5 are in the closing position A, the upper wall 51*a* of the sleeve portion 51 of the casing 5 counter-faces the upper surface 41 of the annular wall 40 of the covering 4; similarly, the lower wall 51*b* of the sleeve portion 51 of the casing 5 faces the lower surface 44 of the annular wall 40 of the covering 4 and the lateral sides 51*c* of the sleeve portion 51 of the casing 5 face two of the four lateral surfaces (the two other lateral surfaces 43 face one the bottom wall 50 of the casing 5 and the other protrudes outside the casing 5) of the annular wall 40 of the covering 4.

The annular wall 40 of the covering 4 is a box-like wall.

According to said embodiment, the covering 4 is ring shaped. In other words, the covering 4 is formed exclusively by the annular wall 40 and does not have any bottom wall. Advantageously, the quantity of material used in the making of package 1 is further limited.

Figure 8:
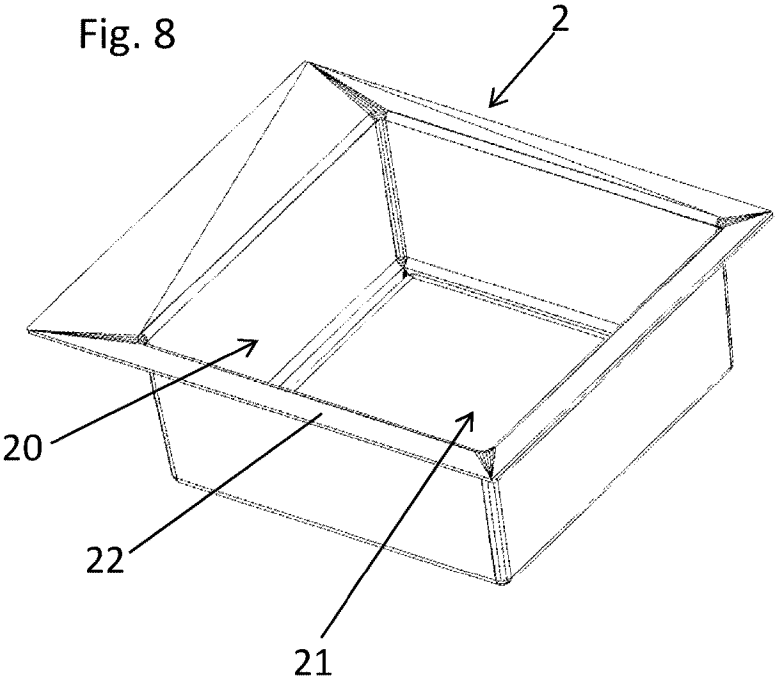
FIGS. 8 and 9 are perspective views, from above and from below, respectively, of the containers of the package of FIG. 1.
Figure 9:
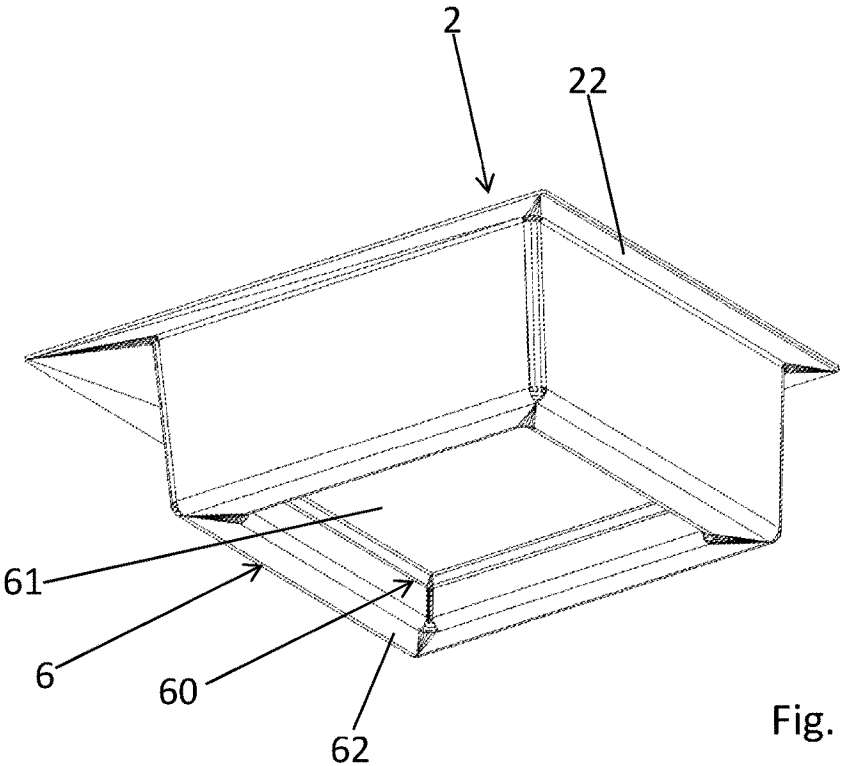

With reference to FIGS. 8 and 9, the first container 2 comprises a containing portion 21 which contains the group of consumer goods and an edge 22, which extends from the containing portion 21.

The first container 2 and the covering 4 are arranged so that the edge 22 of the first container 2 abuts (is arranged resting on) the upper surface 41 of the annular wall 40 of the covering 4.

The closing label 3 is fixed in a repositionable manner (for example by means of a re-stick glue) to the edge 22 of the first container 2. In this way the adhesion of the closing label 3 to the first container 2 is facilitated since it has a large flat surface for adherence. Advantageously, the seal (for example for moisture or aroma) of the package 1 is further improved.

The first container 2 is fixed to the covering 4. In particular, the first container 2 can be mechanically fixed to the covering 4, i.e. the respective containing portion 21 can be wedged into the annular wall 40 of the covering 4. In addition, or alternatively, the first container 2 can be glued to the covering 4.

The first closing label 3 is made of a flexible material. In particular, the first closing label 3 comprises an end fixed (for example with glue) to the casing 5 so that, when the covering 4 and the casing 5 are moved from the closing position A to the opening position B, the first closing label 3 is gradually detached from the first container 2 and, when the covering 4 and the casing 5 are moved from the opening position B to the closing position A, the first closing label 3 is progressively fixed to the first container 2. In detail, the first closing label 3 has a quadrilateral shape and comprises a first end and a second end opposite to one another. The first end is fixed (in a non-removable manner) to the inner surface of the upper wall 51*a* of the casing 5 and the second end is fixed (in a non-removable manner) to the first container 2 or to the covering 4. According to an embodiment not illustrated, in the event that the closing label 3 cannot be opened/re-closed automatically, the closing label can comprise a glue-free gripping tab that can be grasped by the user to be detached/refixed to the first container 2.

With reference to FIGS. 5-9, the package 1 comprises a second container 6 which is suitable for containing waste products and comprises an insertion opening 60 for inserting the waste products into the second container 6. The second container 6 is coated (supported) by the covering 4.

Furthermore, the package 1 comprises a second closing label 7, which is fixed in a repositionable manner (for example by means of re-stick glue) to the second container 6 to open and close the insertion opening 60 so as to allow or prevent the insertion of the waste products into the second container 6. Advantageously, the package 1 is particularly practical for the user who can also use the same to contain waste products.

Figure 7:
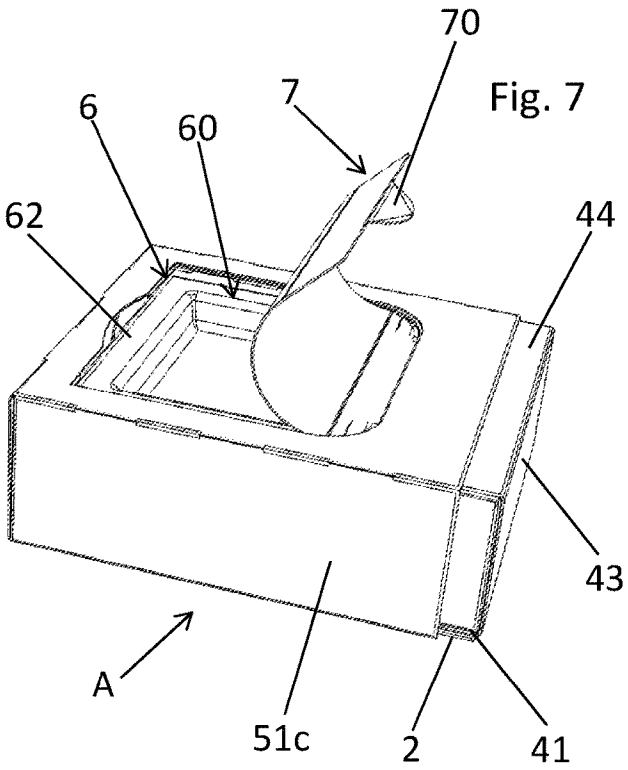
FIGS. 6 and 7 are side and perspective views respectively, of the package of FIG. 5.
Figure 5:
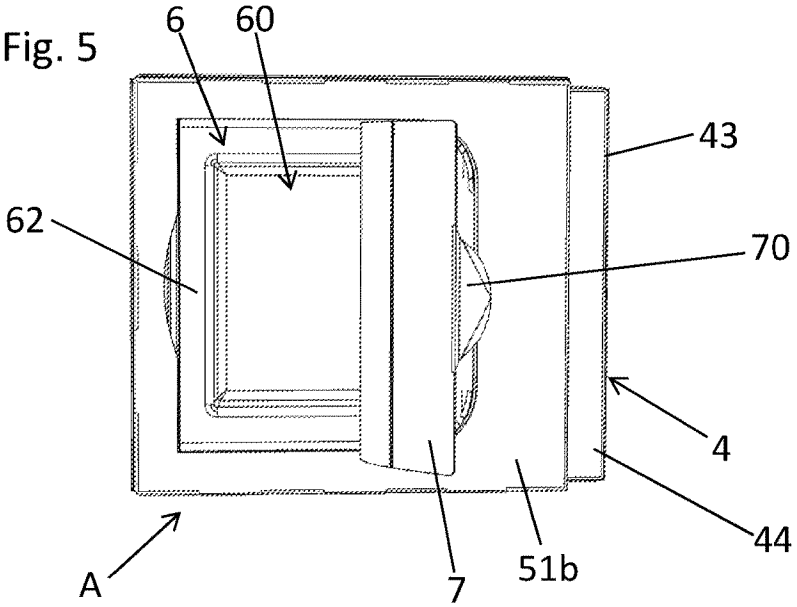
FIG. 5 is a bottom view of the package of FIG. 1.
Figure 6:
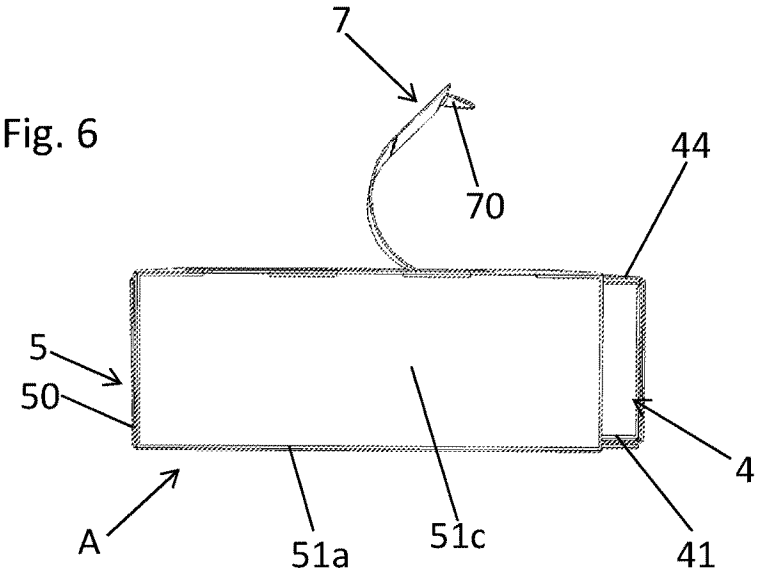

The casing 5 is shaped to allow access to the second container 6 through the insertion opening 60 when the package 1 is in the closing position A (FIGS. 5-7). Advantageously, the user does not have to open the first container 2 to throw away the waste products and this, in addition to being convenient, increases the capacity of the package 1 to preserve the characteristics of the consumer goods.

With reference to FIGS. 5 and 6, the casing 5 comprises an entry window 8 which faces the second closing label 7 (preferably flexible) when the casing 5 and the covering 4 are in the closing position A.

Similarly, to the first container 2, the second container 6 also comprises a containing portion 61 (tub-shaped) designed to contain waste products and an edge 62 which extends from the containing portion 61.

The second container 6 and the casing 5 are arranged and shaped so that the edge 62 of the second container 6 at least partially faces the entry window 8 of the casing 5.

The second closing label 7 is removably fixed (for example by means of re-stick glue) to the edge 62 of the second container 2. In this way the adhesion of the second closing label 7 to the second container 6 is facilitated.

The second closing label 7 is preferably flexible. Furthermore, the second closing label 7 comprises a gripping flap 70, which is glue-free and that can be grasped in order to open the insertion opening 60 of the second container 6.

With reference to FIGS. 8 and 9, the first container 2 and the second container 6 are made in a single body. Advantageously, the use of material for producing the package 1 is minimized.

The first container 2 is rigid. The second container 6 is rigid.

The first container 2 and the second container 6 are made of a thermoformable material (and are made by thermoforming; alternatively, they could be formed by moulding).

In particular, the first container 2 and the second container 6 can be made of a plastic material or of a biodegradable or compostable material (in the latter cases plastic is not advantageously used in making the package 1).

According to a different embodiment not illustrated, the first container 2 and the second container 6 could be two distinct containers. In said case, one or both could be made of a thermoformable material (and be made by way of thermoforming; or alternatively it could be formed by moulding). Furthermore, one or both could be made of a plastic material or of a biodegradable material or of a compostable material.

The first container 2 and the second container 6 are arranged opposite one another and the extraction opening 20 is opposite the insertion opening 60. Advantageously, the package 1 is particularly compact; furthermore, the use of material for the production of the first container 2 and of the second container 6 is minimized.

The package 1 can comprise blocking means 9 (not illustrated in the embodiment of the package 1 of FIGS. 1-9) for blocking the casing 5 and the covering 4 in the closing position A. The blocking means 9 can comprise a slit 90 obtained in the covering 4 and a blocking flap 91 which extends from the first container 2 and engages in the slit 90 when the package 1 is in the closing position A.

In particular, the blocking flap 91 can extend from the edge 22 of the first container 2.

Therefore, in order to extract a product, the user must drag the covering 4 (and therefore the first container 2) with respect to the wrapping 5 along the sliding direction X until the covering 4 and the wrapping 5 are brought into the opening position B. At this point, according to the embodiment illustrated in FIGS. 1-9, the user has access to the consumer goods since the first closing label 3 is automatically opened (according to an embodiment not illustrated, it may be necessary to manually detach the first closing label 3 from the container 2).

Instead, in order to insert a waste product into the second container 6, the user must partially detach the second closing label 7 (by grasping it at the respective gripping flap 70) from the second container 6 when the casing 5 and the covering 4 are in the closing position A.

The package 1 comprises, furthermore end-of-stroke means (not illustrated) which prevent the covering 4 from completely coming out of the casing 5 when the casing 5 and the covering 4 are moved from the closing position A to the opening position B. Said end-of-stroke means can comprise a tab (or rather a pair of tabs, each protruding from a side face 43 of the annular wall 40 of the covering 4) that protrudes from the covering 4 and which engages in a tab of the casing 5 (or rather a pair of tabs projecting from the lateral sides 51*c* of the sleeve portion 51 of the casing 5).

The package 1 can further comprise a covering element (not illustrated) which is welded to the edge 22 of the first container 2 to close the extraction opening 20 of the first container 2. The covering element comprises a central portion that faces the extraction opening 20 of the first container 2 and an edge that at least partially surrounds the central portion and that is welded to the edge 22 of the first container 2. Advantageously, the seal of the package 1 is further improved.

In said embodiment, preferably the first closing label 3 is permanently fixed to the central portion of the covering element and in a repositionable manner to the edge of the covering element so that, when the first closing label 3 is separated from the first container 2, at the first opening of the package 1, the central portion of the covering element is at least partially separated from the edge of the covering element. Advantageously, the adhesion of the first closing label 3 to the edge of the covering element is simpler and more efficient than the adhesion of the first closing label 3 to the edge 22 of the first container 2.

Therefore, the package 1 comprises a permanent adhesive (glue) between the central portion of the covering element and the first closing label 3 and a re-stick adhesive (glue) between the edge of the covering element and the first closing label 3.

In other words, according to said embodiment, the central portion 3 of the covering element is fixed (in a non-removable manner) to the first closing label 3 also after the first opening of the package 1.

Preferably, the covering element is made by a layer (film) of plastic material.

The central portion of the covering element has a shape and sizes substantially similar to the shape and sizes of the extraction opening 20 of the first container 2.

The covering element can comprise a pre-weakened line that separates the central portion of the covering element and the edge of the covering element.

Said pre-weakened line can be a closed line (which substantially coincides in shape and size with the perimeter of the extraction opening 20 of the first container 2); in this case, after the first opening of the package 1, the central portion of the covering element is fixed exclusively to the first closing label 3.

Alternatively, the pre-weakened line can be a U-shaped line (which substantially coincides in shape and size with part of the perimeter of the extraction opening 20 of the first container 2); in this case, after the first opening of the package 1 the central portion of the covering element is fixed to both the first closing label 3 and to the edge of the covering element.

With reference to FIGS. 10-13, a second preferred embodiment of the package 1 object of the present invention is described in the following. This second embodiment of the package 1 comprises most of the features described with reference to the first embodiment (FIGS. 1-9); therefore, in the following, only the differences with respect to the first embodiment will be described with reference to the second embodiment.

Figure 10:
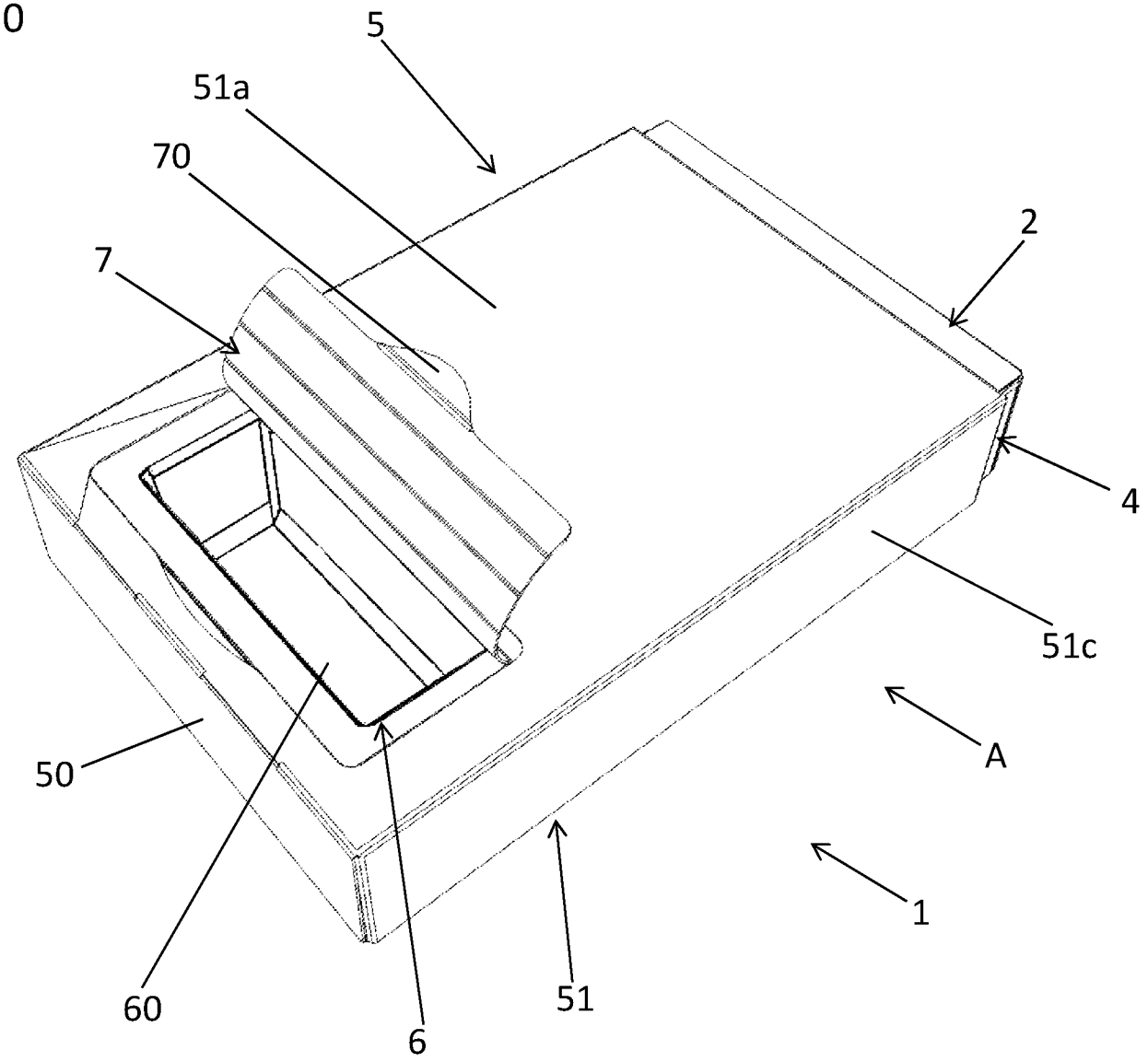
FIG. 10 is a perspective view of a second embodiment of the package object of the present invention, which package is in the closing position.
Figure 11:
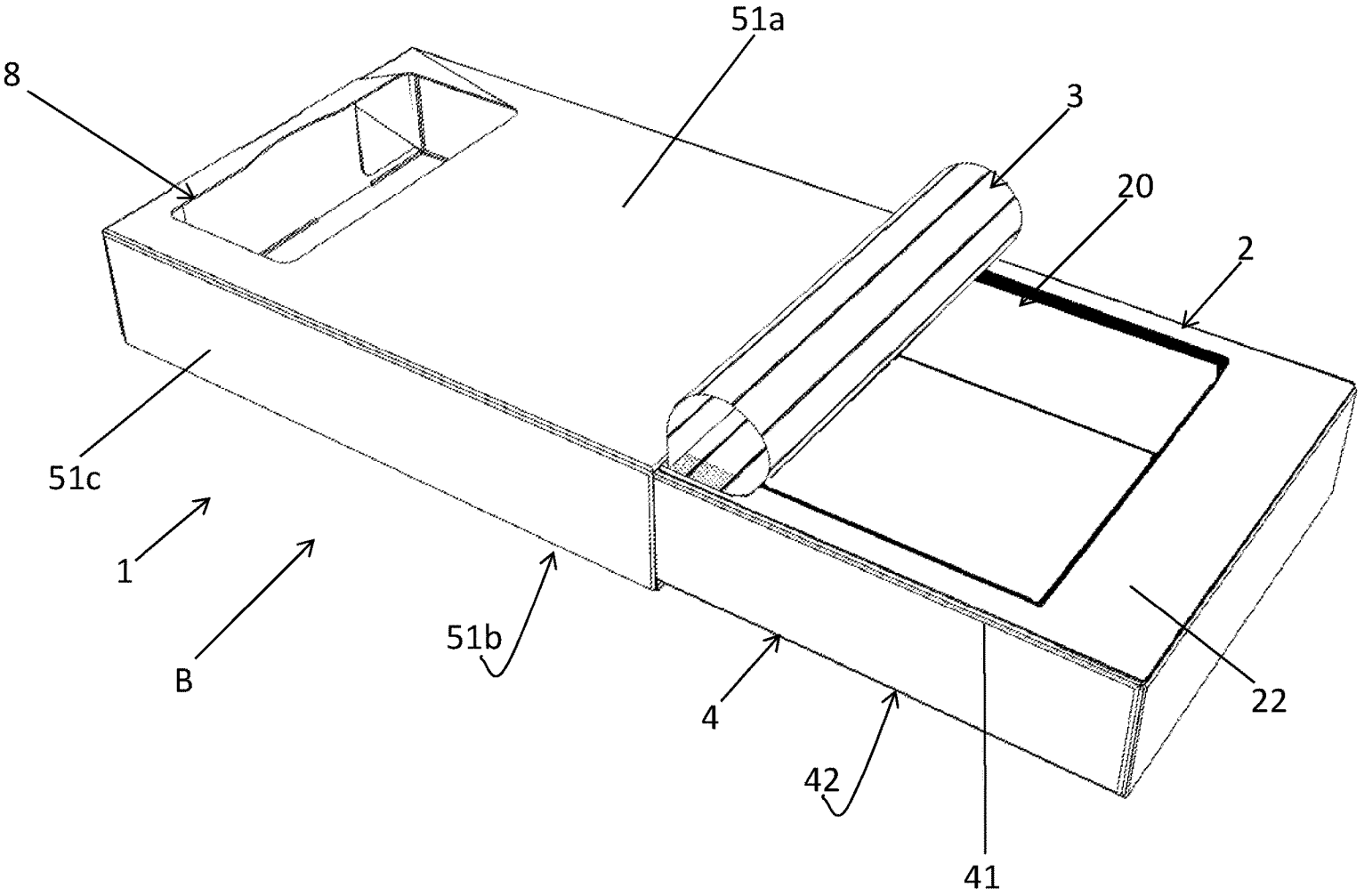
FIG. 11 is a perspective view of the package of FIG. 10 in the opening position.

The package 1 has a substantially rectangular shape 1 in a plan view when it is in the closing position A (FIG. 10). It is understood that it could also have a square shape.

The covering 4 comprises the annular wall 40 which engages in the inner surface of the casing 5 to slide with respect to the casing 5 between the closing position A and the opening position B. The annular wall 40 has the same characteristics described with reference to first embodiment. Differently, however, in said embodiment, the covering 4 also comprises a bottom wall 42 from which the annular wall 40 rises.

When the package 1 is in the closing position A, the bottom wall 42 of the covering 4 faces the lower wall 51*b* of the sleeve portion 51 of the casing.

Figure 12:
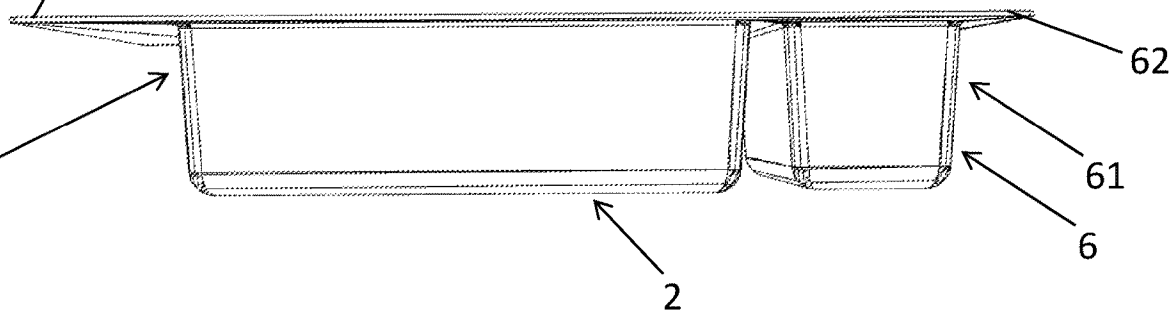
FIGS. 12 and 13 are a side view and a perspective view, respectively, of the containers of the package of FIG. 10.
Figure 13:
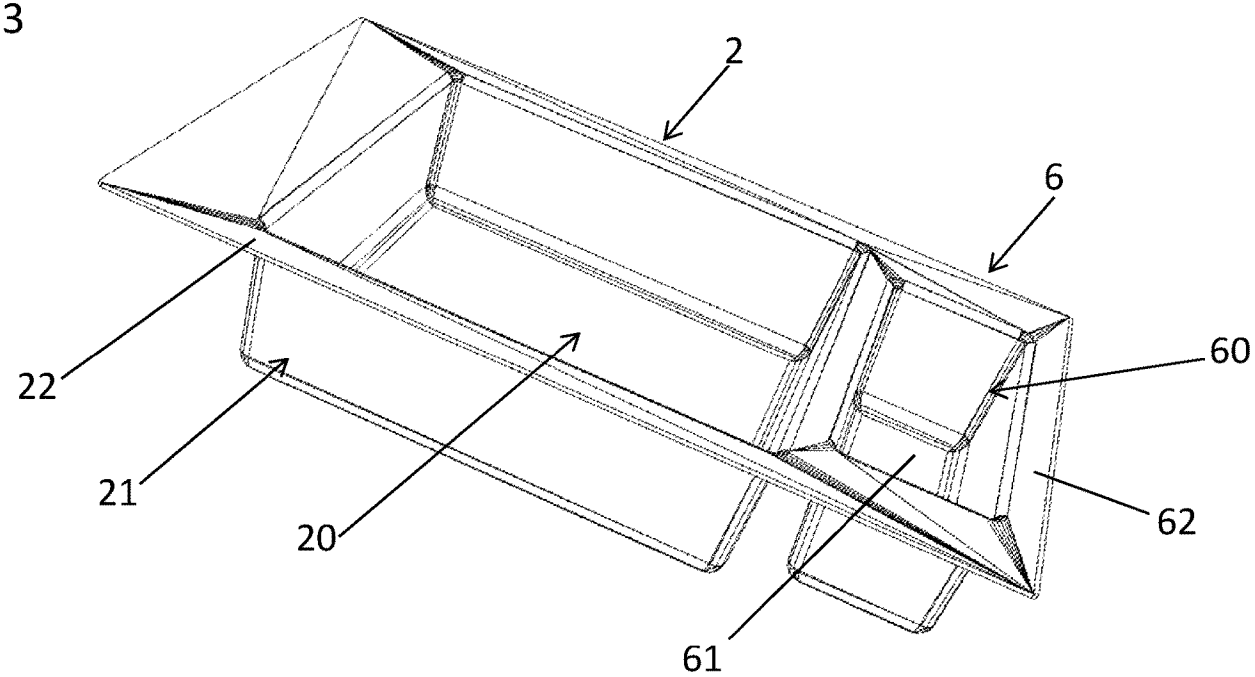

With reference to FIGS. 12 and 13, also in said second embodiment the first container 2 and the second container 6 are made in a single body.

Each of them comprises the respective containing portion 21, 61 and the respective edge 22, 62 which extends from the containing portion 21, 61.

Differently from the first embodiment, the first container 2 and the second container 6 are arranged side by side and the extraction opening 20 is planar to the insertion opening 60.

In said case, the entry window 8 of the casing 5 is obtained at the upper wall 51*a* of the sleeve portion 51 of the casing 5.

Furthermore, in this embodiment, the first closing label 3 and the second closing label 7 can be made in a single body.

Figure 14:
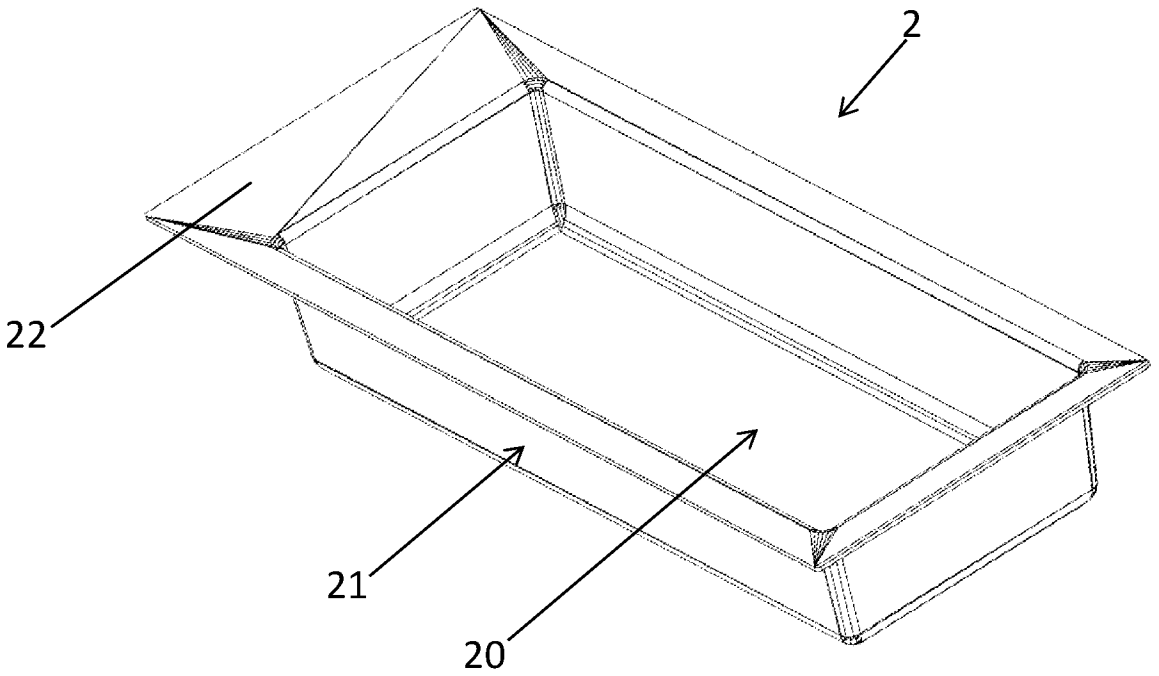
FIG. 14 is a perspective view of an alternative container to that of FIGS. 12 and 13.

With reference to FIG. 14, a first container 2, alternative to that illustrated in FIGS. 12 and 13, is illustrated. In said case, the package 1 provides only the first container 2 for consumer goods and does not provide any second container 6 for waste products.

Said first container 2 is rigid and made of a thermoformable material (for example a plastic or a biodegradable material). According to said embodiment, the casing 5 does not provide any entry window 8.

Figure 15:
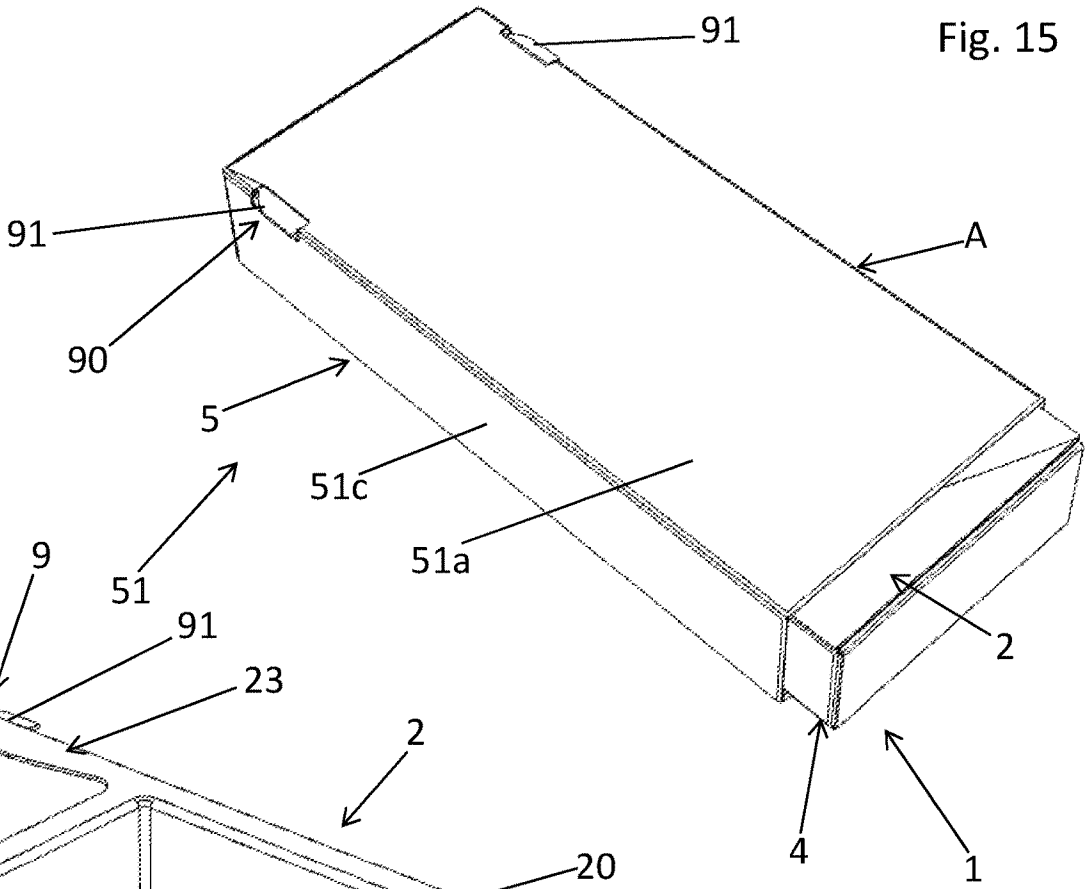
FIG. 15 is a perspective view of a third embodiment of the package object of the present invention, which package is in the closing position.
Figure 16:
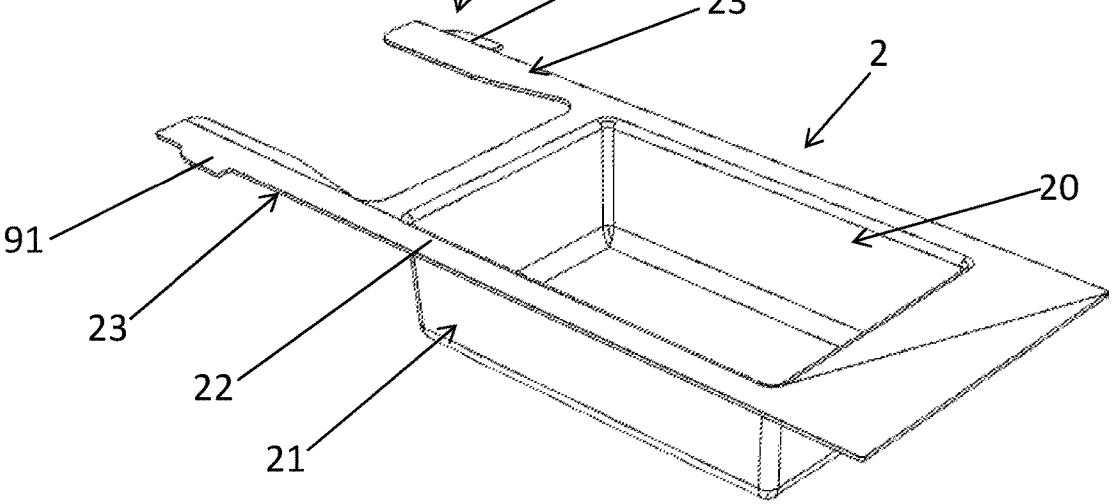
FIG. 16 is a perspective view of the container of the package of FIG. 15.

With reference to FIGS. 15 and 16, a third embodiment of the package 1 object of the present invention is described in the following. Said third embodiment of the package 1 comprises most of the features described with reference to the first embodiment (FIGS. 1-9) and to the second embodiment (FIGS. 10-13); in the following, therefore, only the differences with respect to the previous ones will be described with reference to the third embodiment.

The package 1 provides only the first container 2 for consumer goods and does not provide any second container 6 for waste products. Therefore, the casing 5 does not provide any entry window 8.

Furthermore, said package 1 comprises blocking means 9 to block the casing 5 and the covering 4 in the closing position A. Advantageously, said package 1 is more difficult and childproof to open.

The blocking means 9 comprise a pair of slits 90 made in the casing 5 and a pair of blocking flaps 91 which extend from the first container 2 and engage in the respective slits 90 when the casing 5 and the covering 4 are in the closing position A.

In detail, according to the preferred embodiment, the slits 90 are formed in the sleeve portion 51 of the casing 5 (preferably at the edge between the upper wall 51*a* and the lateral sides 51*c*).

The first container 2 comprises the containing portion 21 and the edge that extends from the containing portion 21 and on which the first closing label 3 is removably fixed. Furthermore, the first container 2 comprises two elongated portions 23 which extend along the sliding direction X of the package 1 and each carrying a respective blocking flap 91. Said elongated portions 23 make it easier to release the package 1 even facing a first container 2 made of a rigid material.

According to an embodiment not illustrated, the covering comprises a bottom wall and a box-like wall which rises from the bottom wall (completely similar to what is described above with reference to the second embodiment) and the first container 2 is a layer (for example a plastic layer) of the covering so that the combination of the layer and of the first closing label can form a package 1 capable of preserving the characteristics of the consumer goods. In this embodiment, the first container 2 and the covering 4 are made in a single body.

With further reference to the latter embodiment, not illustrated, the package 1 can comprise the second container (also in the form of a layer, for example a plastic layer). In this case the covering 4 comprises a first housing covered by the first container and a second housing covered by the second container.

The invention claimed is:

1. A package (1) with a sliding opening for consumer goods, comprising:

a group of consumer goods;

a first container (2) that is tub-shaped, which contains the group of consumer goods and comprises an extraction opening (20) for the extraction of consumer goods from the first container (2);

a first closing label (3) which is fixed in a repositionable manner to the first container (2) to open and close the extraction opening (20) and allow or prevent access to the group of consumer goods;

a covering (4) of the first container (2), which is made starting from a blank of wrapping material; and a casing (5) made starting from a blank of wrapping material, which casing (5) is arranged externally to the covering (4) and is slidingly coupled to the covering (4) so that the casing (5) and the covering (4) are mutually movable along a sliding direction (X) between a closing position (A), in which access to the group of consumer goods contained in the first container (2) is not allowed, and an opening position (B), in which access to the group of consumer goods contained in the first container (2) is allowed; and a second container (6) which is designed to contain waste product and comprises an insertion opening (60) for inserting the waste product into the second container (6), which second container (6) is covered by the covering (4).

2. The package (1) according to claim 1, wherein:

the covering (4) comprises an annular wall (40) that engages in the inner surface of the casing (5) to slide with respect to the casing (5) between the closing position (A) and the opening position (B), which annular wall (40) comprises an upper surface (41) that extends parallel to the sliding direction (X);

the first container (2) comprises a containing portion (21), which contains the group of consumer goods, and an edge (22) that extends from the containing portion (21) and abuts against the upper surface (41) of the annular wall (40) of the covering (4).

3. The package (1) according to claim 2, wherein the closing label (3) is removably fixed to the edge (22) of the first container (2).

4. The package (1) according to claim 2, comprising a covering element which is welded to the edge of the first container (2) to close the extraction opening (20) of the first container (2), which covering element comprises a central portion facing the extraction opening (20) of the first container (2) and an edge that at least partially surrounds the central portion and that is welded to the edge (22) of the first container (2);

the first closing label (3) is fixed in a permanent manner to the central portion of the covering element and is fixed in a repositionable manner to the edge of the covering element so that, when the first closing label (3) is separated from the first container (2) at the first opening of the package (1), the central portion of the covering element is at least partially separated from the edge of the covering element.

5. The package according to claim 4, wherein the covering element comprises a pre-weakened line that separates the central portion of the covering element and the edge of the covering element.

6. The package (1) according to claim 1, wherein the first container (2) is made of a thermoformable material and which is a plastic or biodegradable or compostable material.

7. The package (1) according to claim 1, comprising a second closing label (7) that is fixed in a repositionable manner to the second container (6) to open and close the insertion opening (60) so as to allow or prevent the insertion of the waste products into the second container (6).

8. The package (1) according to claim 7, wherein the covering (4) is shaped to allow access to the second container (6) through the insertion opening (60) when the covering (4) and the casing (5) are in the closing position (A).

9. The package (1) according to claim 8, wherein the first container (2) and the second container (6) are made in a single body.

10. The package (1) according to claim 8, wherein the casing (5) comprises an entry window (8) facing the second closing label (7) when the covering (4) and the casing (5) are in the closing position (A).

11. The package (1) according to claim 8, wherein:

the first container (2) and the second container (6) are arranged side-by-side;

the extraction opening (20) is planar to the insertion opening (60); and the covering (4) comprises a bottom wall (42) and an annular wall (40) which rises from the bottom wall (42).

12. The package according to claim 8, wherein:

the first container (2) and the second container (6) are arranged opposite one another;

the extraction opening (20) is opposite the insertion opening (60); and the covering (4) is ring-shaped.

13. The package (1) according to claim 8, wherein the second container (6) is made of a thermoformable material and which is a plastic or biodegradable or compostable material.

14. The package (1) according to claim 1, comprising blocking means (9) for blocking the covering (4) and the casing (5) in the closing position (A), which blocking means (9) comprise a slit (90) formed in the casing (5) and a blocking flap (91) which extends from the first container (2) and engages in the slit (90) when the package (1) is in the closing position (A).

15. The package (1) according to claim 1, wherein the first closing label (3) is made of a flexible material and comprises an end fixed to the casing (5) so that, when the covering (4) and the casing (5) are moved from the closing position (A) to the opening position (B), the first closing label (3) is gradually detached from the first container (2) and, when the covering (4) and the casing (5) are moved from the opening position (B) to the closing position (A), the first closing label (3) is progressively fixed to the first container (2).

16. A package (1) with a sliding opening for consumer goods, comprising:

a group of consumer goods;

a first container (2) that is tub-shaped, which contains the group of consumer goods and comprises an extraction opening (20) for the extraction of consumer goods from the first container (2);

a first closing label (3) which is fixed in a repositionable manner to the first container (2) to open and close the extraction opening (20) and allow or prevent access to the group of consumer goods;

a covering (4) of the first container (2), which is made starting from a blank of wrapping material; and a casing (5) made starting from a blank of wrapping material, which casing (5) is arranged externally to the covering (4) and is slidingly coupled to the covering (4) so that the casing (5) and the covering (4) are mutually movable along a sliding direction (X) between a closing position (A), in which access to the group of consumer goods contained in the first container (2) is not allowed, and an opening position (B), in which access to the group of consumer goods contained in the first container (2) is allowed;

a second container (6) which is designed to contain waste products and comprises an insertion opening (60) for inserting the waste products into the second container (6), which second container (6) is covered by the covering (4);

wherein the covering (4) comprises an annular wall (40) that engages in the inner surface of the casing (5) to slide with respect to the casing (5) between the closing position (A) and the opening position (B), which annular wall (40) comprises an upper surface (41) that extends parallel to the sliding direction (X);

wherein the first container (2) comprises a containing portion (21), which contains the group of consumer goods, and an edge (22) that extends from the containing portion (21) and abuts against the upper surface (41) of the annular wall (40) of the covering (4); and wherein is provided a covering element which is welded to the edge of the first container (2) to close the extraction opening (20) of the first container (2), which covering element comprises a central portion facing the extraction opening (20) of the first container (2) and an edge that at least partially surrounds the central portion and that is welded to the edge (22) of the first container (2); the first closing label (3) is fixed in a permanent manner to the central portion of the covering element and is fixed in a repositionable manner to the edge of the covering element so that, when the first closing label (3) is separated from the first container (2) at the first opening of the package (1), the central portion of the covering element is at least partially separated from the edge of the covering element.

17. The package according to claim 16, wherein the covering element comprises a pre-weakened line that separates the central portion of the covering element and the edge of the covering element.

* * * * *